US005257516A

United States Patent [19]

Hossfield

[11] Patent Number: 5,257,516

[45] Date of Patent: Nov. 2, 1993

[54] WASHING MACHINE

[75] Inventor: Robin C. Hossfield, Medway, Mass.

[73] Assignee: Raytheon Company, Lexington, Mass.

[21] Appl. No.: 892,101

[22] Filed: Jun. 2, 1992

[51] Int. Cl.[5] ..... D06F 37/24

[52] U.S. Cl. ..... 68/23.3; 248/188.3; 248/613

[58] Field of Search ..... 68/3 R, 23 R, 23.1, 68/23.3; 494/82; 210/144, 363, 364; 248/188.2, 188.3, 610, 613

[56] References Cited

U.S. PATENT DOCUMENTS

| | | | |
|---|---|---|---|
| 2,583,579 | 1/1952 | Lodge | 248/613 X |
| 3,021,956 | 2/1962 | Bochan | 68/23.3 X |
| 3,556,446 | 1/1971 | Bochan | 210/364 X |
| 3,592,422 | 7/1971 | Paine et al. | 248/613 X |
| 3,616,661 | 11/1971 | Menk | 68/23.3 |
| 4,015,806 | 4/1977 | Cattermole | 248/188.2 X |
| 4,250,724 | 2/1981 | Altnau | 68/23.3 X |
| 4,262,870 | 4/1981 | Kretchmann et al. | 248/188.3 |
| 4,270,718 | 6/1981 | Conner, Jr. | 248/188.3 |
| 4,801,114 | 1/1989 | Price | 248/188.3 |
| 4,949,923 | 8/1990 | Daily | 248/188.3 |
| 5,117,658 | 6/1992 | Bisplinghoff et al. | 68/23.3 |

FOREIGN PATENT DOCUMENTS

| | | | |
|---|---|---|---|
| 1241122 | 5/1967 | Fed. Rep. of Germany | 248/188.2 |

*Primary Examiner*—Philip R. Coe

*Attorney, Agent, or Firm*—William R. Clark; Richard M. Sharkansky

[57] ABSTRACT

A washing machine having the cabinet decoupled from the suspension system in order to eliminate undesirable resonance mode walking conditions. The cabinet is frictionally attached to the washer supporting feet. With this arrangement, the effect of the cabinet on the washer/floor natural frequency is eliminated, thereby increasing such natural frequency above the spin speed of the washer. In this way, walking typically occurring at the natural frequency (i.e. when the spin speed matches the natural frequency of the washer and floor system) is prevented. This arrangement further provides decreased cabinet vibration and noise during operation at typical spin speeds.

12 Claims, 8 Drawing Sheets

WASHING MACHINE

BACKGROUND OF THE INVENTION

This invention relates generally to clothes washing machines and more particularly to a washing machine having a suspension system capable of moving relative to the cabinet.

As is known in the art, washing machines may vibrate under certain operating conditions, and, in aggravated cases may even move (or "walk"). The noise level of the washer operation often increases significantly when such vibration occurs. This undesirable vibration occurs generally when the forces exerted on the washer's supporting feet exceed the resistive frictional forces between the supporting feet and the floor. Such a condition may be referred to generally as causing "frictional" mode vibration. One specific operating condition under which frictional mode vibration occurs is when the rate at which the washer's tub assembly is rotated, during a spin drying cycle for example, is the same as the natural or resonant frequency of the washer. This type of vibration may thus be referred to as "resonant" mode vibration. Note that while washers have various associated natural or resonant frequencies, such as that corresponding to the spring constant of the suspension springs and that associated with the mechanical system comprising the washer and floor, it is the latter natural frequency that often corresponds to the spin rate, thereby causing resonant mode vibration.

As is also known in the art, the natural frequency associated with a washing machine/floor system is a function of, inter alia, the moment of inertia of the machine, the spring constant associated with the floor (i.e. a function of the floor's stiffness), and the spring constant associated with the washer (i.e. a function of the stiffness of the particular washer's structural components).

One way known in the art to reduce the tendency of the machine toward resonant mode vibration is to design the machine so that the natural frequency associated with the washer/floor system does not correspond to the spin speed. For example, this natural frequency can be increased by decreasing the moment of inertia of the cabinet and base, such as by using plastic rather than metal tubs. While this technique may increase the washer/floor natural frequency, in some cases above the spin speed, it does not eliminate the resonant vibration problem for all expected home floors given the variation in the spring constants of such floors.

Other techniques for reducing such vibration were suggested in *Consumer Reports Magazine,* February 1991, page 116, including the use of a thick plywood panel under the washer or stiffening the floor joists. In this way, the spring constant of the floor (and the washer/floor natural frequency proportional thereto) is increased. While this technique may assist in reducing a machine's tendency toward resonant vibration, it may be costly and inconvenient to practice.

SUMMARY OF THE INVENTION

With the foregoing background in mind, it is an object of the present invention to provide an improved washing machine having a reduced occurrence of vibration or walking.

It is a further object to provide a washing machine with a reduced occurrence of resonant mode vibration.

A still further object is to increase the natural frequency of the washer/floor system.

Another object of the present invention is to provide a washing machine which is relatively quiet during operation.

These and other objects of the invention are attained generally by providing a washing machine comprising a cabinet, a tub assembly disposed in the cabinet for processing a wash load, with the tub assembly comprising a drain tub and a spin tub disposed in the drain tub. The washer further comprises a suspension for supporting the tub assembly in the cabinet and for permitting the tub assembly to pivot. Also provided is means for permitting the suspension means to move relative to the cabinet. Preferably, the suspension comprises a pedestal, with the pedestal including a plurality of supporting feet and a collar spaced from the plurality of supporting feet by a plurality of upstanding legs, wherein the tub assembly is disposed over the collar.

With this arrangement, the natural frequency of the washer/floor system is increased. More particularly, the means for permitting the suspension means to move relative to the cabinet eliminates the direct transfer of forces, exerted on the suspension by the pivoting tub assembly, to the cabinet. That is, the relatively heavy cabinet remains substantially stationary as the lighter pedestal moves when subjected to forces caused by the pivoting tub assembly. In this way, the moment of inertia of the cabinet does not affect the natural frequency of the washer/floor mechanical system. Moreover, as such natural frequency is inversely proportional to the moment of inertia of the pedestal only (i.e. instead of being related to the moment of inertia of the cabinet also), the natural frequency is increased. In fact, such natural frequency is increased above the maximum spin speed of the washer for all expected home floors given the variation in the spring constants of such floors. Thus, since the spin speed with which the tub assembly is rotated never passes through (i.e. corresponds to) this natural frequency, resonant mode vibration is avoided for all expected home floors.

In accordance with a further aspect of the invention, a washing machine is provided having a cabinet, a tub assembly, and a suspension for supporting the tub assembly in the cabinet and for permitting the tub assembly to pivot, as described above. The washer further comprises means for slidably attaching or securing the cabinet to the suspension. With this arrangement, the mass of the cabinet is isolated or decoupled from the spring constant of the floor. In other words, such arrangement eliminates the transferring of forces directly from the pivoting tub assembly through the suspension and to the cabinet. As mentioned above, the moment of inertia of the cabinet then has no effect on the natural frequency of the washer/floor mass/spring system, thereby increasing such natural frequency. As such natural frequency is increased above the maximum spin speed of the washer, resonant mode vibration is avoided for all expected home floors.

BRIEF DESCRIPTION OF THE DRAWINGS

The above mentioned and other features of the invention will become more apparent by reference to the following description taken together with the accompanying drawings, in which.

DESCRIPTION OF THE PREFERRED EMBODIMENTS

Figure 1:
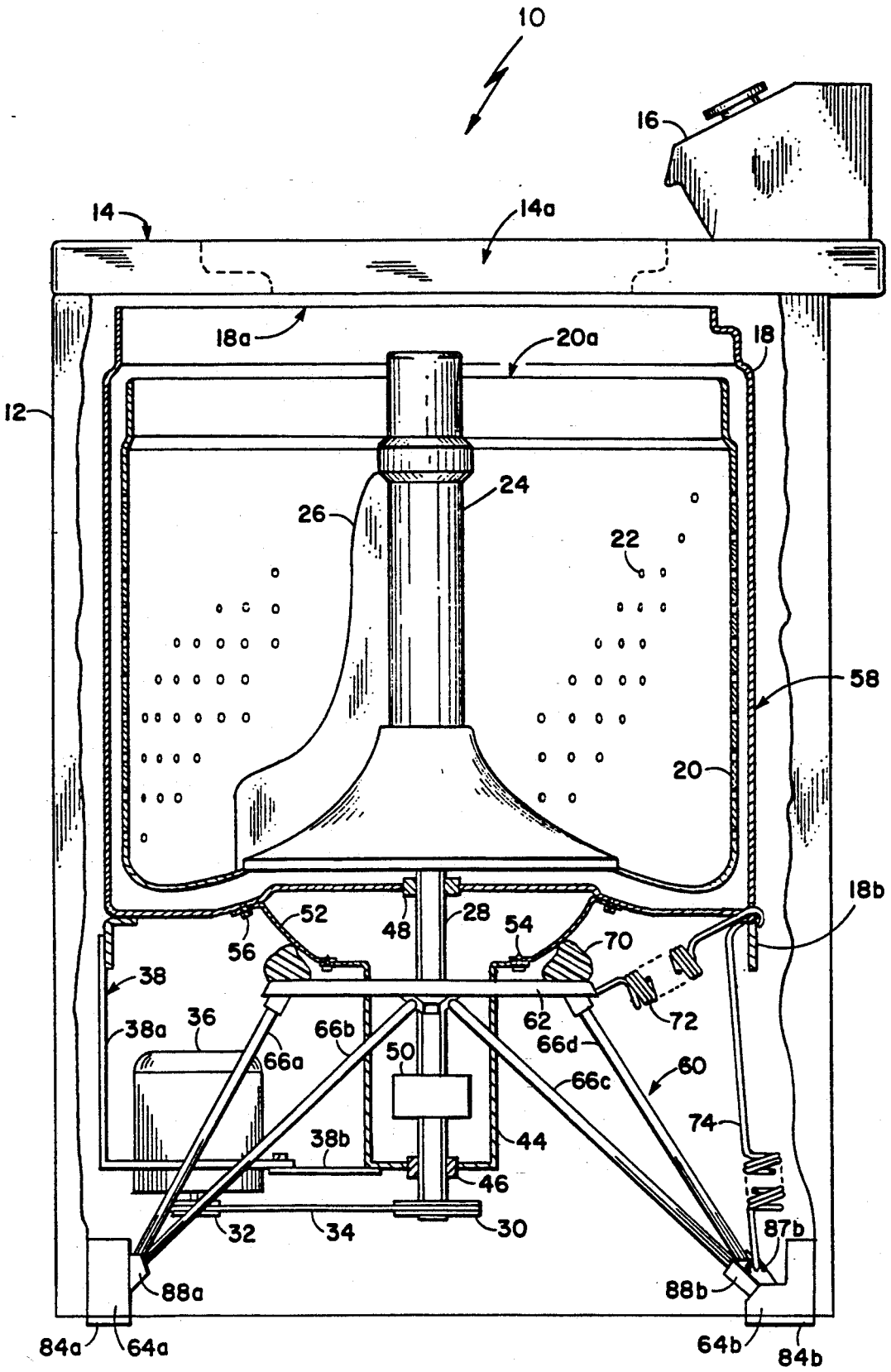
FIG. 1 is a partially sectioned view of a washing machine.

Referring now to FIG. 1, a washing machine 10 is shown to include an outer cabinet 12 having a top cover 14 and a conventional control panel 16. Top cover 14 has a lid opening 14*a* disposed therein for receiving a wash load. More specifically, the wash load is passed through lid opening 14*a* and into a spin tub 20 for processing. Spin tub 20 is disposed inside a drain tub 18, as is conventional. Here, drain tub 18 and spin tub 20 are comprised of metal coated with a suitable material such as porcelain.

In operation, washing machine 10 is automatically cycled through various operations. For example, the operations may include a presoaking stage, a washing stage, a rinsing stage, and a spin drying stage. During spin drying, the spin tub 20 is rotated at a relatively high rate of speed, such as between 500 rpm and 700 rpm. The centrifugal force thus exerted on the wash load inside the spin tub 20 forces the load, or clothes, outwardly along the sides of the spin tub 20 and liquid is extracted therefrom. The liquid thus extracted is directed through perforations 22 in spin tub 20 and into the drain tub 18. A drain hole (not shown) in the drain tub 18 permits the extracted liquid to exit washing machine 10 through a conduit (not shown), as is conventional.

An agitator 24 is disposed within spin tub 20 and includes a plurality of fins, one of which 26 is shown here. During the washing stage, agitator 24 is rotatably moved in order to agitate the clothing in the spin tub 20 thereby facilitating the removal of dirt.

Washing machine 10 further includes a conventional drive shaft 28, drive pulley 32, driven pulley 30, belt 34, and motor 36 described in U.S. Pat. No. 5,117,658 issued on Jun. 2, 1992 entitled "Washing Machine Having Improved Out-of-Balance Performance", such Patent being assigned to the assignee of the present invention and incorporated herein by reference. Here, motor 36 is mounted to substantially stationary drain tub 18 by a bracket 38, as shown. More particularly, motor bracket 38 has a first L-shaped portion 38*a* coupling the motor 36 to the drain tub 18 and a second portion 38*b* coupling the L-shaped portion 38*a* to a bearing housing 44, as shown. With such coupling, assembly of the washing machine 10 is facilitated, as will be described below. Furthermore, the coupling between motor 36 and bearing housing 44 maintains the belt 34 at a suitable tension. Note, however, that other types of motor brackets or motor mounting schemes may alternatively be used.

A transmission 50 is coupled to drive shaft 28 and transforms the power and rotational speed of the motor 36 to a level appropriate for the independent rotation of spin tub 20 and agitator 24. Here, a permanent split capacitor motor 36 is used which in turn permits the use of a smaller transmission 50 than conventionally required, as described in the above-referenced patent.

A lower bearing 46 is disposed concentrically around the drive shaft 28 to permit free rotation thereof. Similarly, an upper bearing 48 is disposed concentrically around drive shaft 28 and adjacent to the bottom wall of drain tub 18, as shown. When the spin tub 20 is rotated, for example during the spin drying stage, the drain tub 18 pivots or tilts, thereby producing forces on lower and upper bearings 46, 48, respectively. Here, bearing housing 44 is coupled at a lower aperture thereof to lower bearing 46 and surrounds transmission 50, as shown. More particularly, bearing housing 44 rigidly couples the lower bearing 46 to the bottom wall of drain tub 18. Specifically, such rigid coupling is achieved by the rigid coupling of a top portion of housing 44 to a pivot dome 52, here by bolts 54 as shown. Pivot dome 52 is further rigidly coupled to the bottom wall of drain tub 18, here by bolts 56, but alternatively by any suitable fastening means. The coupling thus provided locates the drive shaft 28 perpendicular to the bottom wall of drain tub 18, thereby alleviating the forces caused by the pivoting or tilting of drain tub 18 on the lower bearing 46.

Figure 5A:
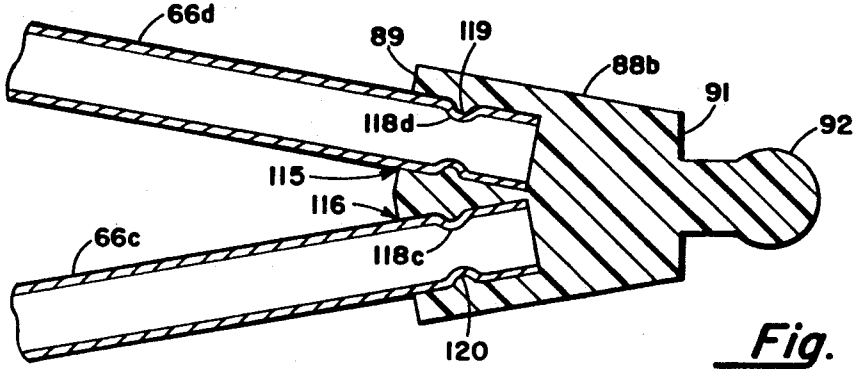
FIG. 5A is an enlarged partially sectioned view of a lower joint of the washer suspension of FIG. 5.

The above described washer components provide a modular tub assembly 58. More specifically, the modular tub assembly 58 (FIG. 5) includes drain tub 18, spin tub 20, bearing housing 44, pivot dome 52, and all of the parts contained therein (i.e. agitator 24, drive shaft 28, and bearings 46, 48). Here, the modular tub assembly 58 further includes motor 36 along with motor bracket 38, as shown in FIG. 5.

Washing machine 10 further includes a suspension for supporting the tub assembly 58 inside cabinet 12 and for permitting the tub assembly 58 to pivot. More particularly, the suspension shown in FIG. 1 includes a pedestal 60, a traversing member 70, a plurality, and here four (FIG. 5), supporting feet 64 and a plurality of centering springs 72 and upright springs 74, as will be described. During washer operation, tub assembly 58 exerts both vertical and horizontal forces on the suspension. The suspension shown in FIGS. 1 and 5 is of a mid-level type and here, permits the tub assembly 58 to both pivot and traverse. However, the suspension arrangement may alternatively be of a base level, fixed pivot type (FIG. 7) or a pendulous type (FIG. 3), as will be discussed below.

Mid-level pedestal 60 includes a collar 62 spaced from the plurality of supporting feet 64*a*–64*d* (only two of which 64*a* and 64*b* can be seen in FIG. 1), by a plurality of upstanding legs 66*a*–66*h*. The specific arrangement of the legs 66*a*–66*h* and the manner with which they are coupled between the collar 62 and the plurality of supporting feet 64*a*–64*d* will be described in greater detail below. Suffice it to say that here, eight such legs 66*a*–66*h* are used to provide a truss-like pedestal arrangement 60. Traversing member 70 is disposed over collar 62, as shown in FIG. 1 in cross section and is comprised of a material having a relatively low coefficient of friction to permit such member 70 to traverse over collar 62. Here, traversing member 70 is comprised of acetal homopolymer sold under the product name of Delrin TL by Dupont of Wilmington, Del. A detailed discussion of the design an construction of traversing member 70 is provided in the above-referenced U.S. Pat. No. 5,117,658. Suffice it here to say that pivot dome 52 is seated on traversing member 70, as shown in FIG. 1. With this arrangement, the tub assembly 58 is free to pivot on traversing member 70. Furthermore, tub assembly 58 can traverse as member 70 traverses over collar 62.

Washing machine 10 further includes a plurality of centering springs 72 coupled between the collar 62 and a lip 18*b* extending from the bottom wall of drain tub 18. Centering springs 72 maintain the tub assembly 58 in a central position with respect to the plurality of legs 66*a*–66*h*. The machine 10 further includes a plurality of upright springs 74 coupled between the lip 18*b* attached to the bottom wall of drain tub 18 and here, a plurality of lower joints 88*a*–88*d*. More specifically, such upright springs 74 are coupled to hooks 87*a*–87*d* extending from the plurality of lower joints 88*a*–88*d*, respectively, as shown here for joint 88*b*. The upright springs 74 function to hold the tub assembly 58 in an upright position, thereby operating against the tendency of the tub assembly 58 to tilt or pivot about the traversing member 70. Preferably, the spring constant associated with the centering springs 72 and that associated with the upright springs 74 are selected to ensure that the maximum pivoting excursion of tub assembly 58 occurs at a different rotational speed of the spin tub 20 than the maximum traversing excursion thereof. The manner of implementing such an arrangement is described in detail in U.S. Pat. No. 5,101,645 entitled "Suspension System for Automatic Washing Machine", issued on Apr. 7, 1992, assigned to the assignee of the present invention, and incorporated herein by reference.

With the washing machine 10 described above, the pedestal 60 is permitted to move relative to the cabinet 12. The manner in which this is accomplished will become apparent from the following description of FIG. 2 which shows an exemplary one 64*b* of supporting feet 64*a*–64*d* and the manner of its attachment to the surrounding cabinet 12.

Figure 2:
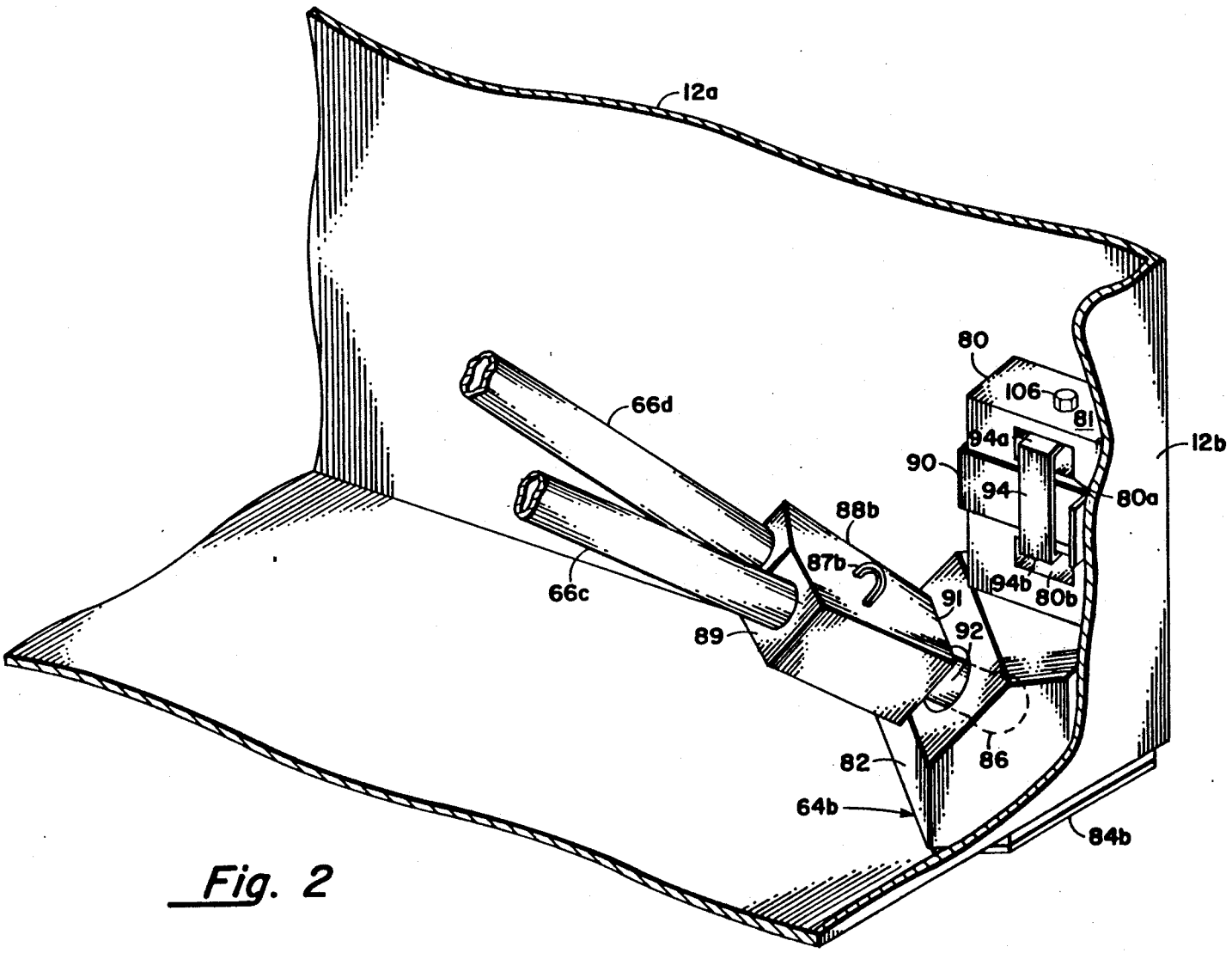
FIG. 2 is an isometric view of a supporting foot of the washing machine of FIG. 1.

Referring now to FIG. 2, exemplary supporting foot 64*b* comprises an upper, cabinet mating portion 80, a lower, pedestal attachment portion 82, and a friction pad 84*b* which contacts the floor surface. In the preferred supporting foot 64*b*, the upper, cabinet mating portion 80 and the lower, pedestal attachment portion 82 are a unitary part, formed by conventional injection molding techniques. More specifically, here the cabinet mating portion 80 and the pedestal attachment portion 82 are comprised of acetal, selected because of its strength, low coefficient of friction, and lubricity. The friction pad 84*b* is here comprised of rubber and is attached to the bottom surface of lower portion 82 by any suitable adhesive.

The pedestal attachment portion 82 has a socket 86 disposed therein, as shown in dotted lines. Socket 86 provides means for rotatably attaching a pair 66*c*, 66*d* of upstanding legs 66*a*–66*h* to supporting foot 64*b*. More particularly, lower joint 88*b* attaches, or connects upstanding legs 66*c*, 66*d* to corresponding supporting foot 64*b*, as shown. The assembly of upstanding legs 66*a*–66*h*, lower joints 88*a*–88*d*, and supporting feet 64*a*–64*d* will be described in greater detail below. Suffice it to say however that the lower joints 88*a*–88*d* are molded plastic parts, here comprised of acetal homopolymer sold under the product name of Celcon by Hoechst Celanese Corporation of Chatham, N.J. As can be seen from exemplary joint 88*b*, such lower joint 88*b* has a first end 89 having a pair of adjacent apertures in which ends of upstanding legs 66*c*, 66*d* are disposed. A second end 91 of joint 88*b* has a ball joint 92 extending therefrom which, in assembly, is disposed in socket 86, as shown.

A coupling bracket 90 is fixedly secured to the cabinet 12 at either end thereof. More particularly, coupling bracket 90 is, here, an elongated piece of sheet metal bent to conform to the upper portion 80 of foot 64*b* and welded at either end thereof to orthogonal walls 12*a*, 12*b* of cabinet 12, as shown. The above described supporting foot 64*b* and its attachment to cabinet 12 by bracket 90 provides means for frictionally attaching the foot 64*b* (and thus the entire pedestal 60 attached thereto) to the cabinet 12. In other words, by frictionally attached, it is meant that there is no fixed coupling, such as by a welded joint, between the cabinet 12 and the supporting feet 64*a*–64*d* and pedestal 60 combination. The attachment here provided between the cabinet 12 and the supporting feet 64*a*–64*d* may also be referred to as slidable or moveable attachment. Since the pedestal 60 is not fixed to the cabinet 12, pedestal 60 is permitted to move relative to such cabinet 12. Stated differently, the attachment between the cabinet 12 and the supporting feet 64*a*–64*d*/pedestal 60 combination is such that the cabinet 12 may remain substantially stationary while the pedestal 60 is in motion or vibrating as a result of forces exerted thereon by tub assembly 58.

More specifically, in operation, when the tub assembly 58 pivots and/or traverses, vertical and/or horizontal forces or loads are exerted on supporting feet 64*a*–64*d* via pedestal 60. These forces are, in turn, transferred to the floor through such feet 64*a*–64*d*. In conventional washing machines, in which the supporting feet are fixedly coupled or secured to the cabinet, the cabinet along with the supporting feet, is subjected to such forces. In other words, the forces exerted by the tilting and/or traversing tub assembly 58 on the supporting feet have heretofore been concomitantly exerted on the washer cabinet. With the present arrangement, however, such forces exerted on supporting feet 64*a*–64*d* are not directly coupled to the cabinet 12 since the coupling between such feet 64*a*–64*d* and cabinet 12 is frictional as opposed to fixed. Stated differently, when vertical forces for example, are exerted on foot 64*b*, and such foot 64*b* deflects downwardly or upwardly, the upper cabinet mating portion 80 of foot 64*b* slides downwardly or upwardly, respectively, within the bracket 90. That is, supporting feet 64*a*–64*d* are pushed or forced outward against the corresponding corner and slide vertically, thereby moving relative to the surrounding cabinet 12 and bracket 90. With this arrangement, the cabinet 12 is supported in a manner decoupled from the pedestal 60 so that the cabinet 12 is driven only by frictional or dampening forces exerted by the supporting feet 64*a*–64*d* and is not affected directly by the spring rate of the floor. Viewed differently, in conventional washers where the supporting feet are fixedly attached to the cabinet, the cabinet and suspension are excited by forces exerted by the pivoting tub assembly 58. In the present arrangement however, the cabinet 12 is isolated from the suspension (i.e. pedestal 60 in the embodiment of FIG. 1) by the frictional coupling which can be represented or modelled as a friction damper. Thus, when force is exerted on the pedestal 60 by the pivoting tub assembly 58, such forces are damped by the frictional mating between such pedestal 60 and the cabinet 12. Moreover, as the pedestal 60 is directly coupled to the floor surface by supporting feet 64a–64d, the cabinet is also isolated from the spring constant of the floor.

It should be appreciated from the above description that supporting feet 64a–64d may be provided in a variety of shapes and sizes. For example, the feet 64a–64d may have a triangular cross section. It should also be appreciated that the supporting feet 64a–64d may be comprised of any material having a suitably low coefficient of friction. The preferred the material of the feet 64a–64d has a coefficient of friction of less than or equal to 0.25. Such material will insure that the supporting feet 64a–64d are permitted to move relative to the surrounding cabinet 12 and coupling bracket 90, as described above.

With the above described mating between pedestal 60 and cabinet 12 (i.e. specifically the frictional, as opposed to fixed, coupling between supporting feet 64a–64d and cabinet 12), the tendency of the washing machine 10 to vibrate or walk is reduced. More particularly, as mentioned, one operating condition under which washing machine 10 may vibrate is when the natural, or resonant frequency of the washer/floor system is the same as the frequency at which the spin tub 20 is rotated, for example during the spin drying cycle. Such vibration is reduced by the pedestal attachment arrangement described above by providing the washing machine 10 with a higher natural frequency than heretofore achieved. Specifically, such natural frequency is substantially higher than the spin cycle rotation rate.

More particularly, a washing machine 10 has various resonant or natural frequencies associated therewith. For example, a resonant frequency may occur at a rate between approximately one hundred and two hundred rpm and be associated with the spring constant, or constants, of the upright springs 74 and/or the centering springs 72. Another resonant frequency of the washing machine 10 occurs at a significantly higher speed (in conventional washers between approximately 500 rpm and 700 rpm) and is associated with the spring constant of the system comprising the floor/washer arrangement. It is this latter natural frequency which often corresponds to the steady-state spin cycle frequency, thereby causing resonant mode vibration. In other words, consider a conventional washer having a natural frequency at approximately 600 rpm. If the rate of rotation of the tub assembly 58 is approximately 600 rpm, the machine 10 will vibrate when the tub assembly is rotated at such rate. As mentioned, the present washing machine 10 overcomes this vibration phenomena by having a natural frequency different from, and here substantially greater than, the rate of rotation of the tub assembly 58.

The way in which the natural frequency is increased will be better understood from the following equation for natural frequency:

$$W_n = \frac{1}{2\Pi} \sqrt{K/I} \tag{1}$$

in which $W_n$ is the natural frequency in rpm, K is the composite spring constant associated with the washer/floor system, and I is the moment of inertia of, here the pedestal 60. The spring constant K is a function of the spring constant of the floor ($K_f$) and the spring constant of the pedestal 60 ($K_s$). More particularly, the composite spring constant K is given by:

$$K = \frac{K_f K_s}{K_f + K_s} \tag{2}$$

The moment of inertia I is given by the following equation:

$$I = mp^2 \tag{3}$$

where m is, here, the mass of the pedestal 60 and p is the radius of gyration of the machine 10 (i.e. the distance between the floor and the location of the center of mass of the suspension, here of pedestal 60). Note that in conventional washing machines, the mass associated with the moment of inertia used to compute the natural frequency of the washer/floor system additionally includes that of the cabinet since the cabinet in such washers is fixedly attached to the suspension. Note also that the radius of gyration of conventional washers is larger than that of the washer 10 herein presented. Here the radius of gyration is approximately 5.5 inches; whereas, prior art washers in which the cabinet is fixed to the suspension have a typical radius of gyration of approximately twenty-four inches. From the foregoing equations, it is apparent that this natural frequency is inversely proportional to the mass of the pedestal 60 and the radius of gyration. In the present design, the elimination of fixed coupling between the pedestal 60 an the cabinet 12 reduces the effect of the moment of inertia of the cabinet 12 on the natural frequency. Stated differently, the mating between cabinet 12 and supporting feet 64a–64d provides means for isolating the moment of inertia of the cabinet 12 to provide the washing/floor natural frequency above the maximum spin speed of the spin tub 20. Thus, in the present system, the moment of inertia contributing to the washer/floor natural frequency is solely that of the pedestal 60 and here, is approximately 5 lbs. Here, the resulting natural frequency is equal to approximately 8,000 rpm, significantly greater than the spin cycle rate of, here approximately 600 rpm. Thus, as the tub assembly 58 is rotated up to and at its steady-state spin speed, its rotational speed is never equal to the natural frequency associated with the washer/floor system.

In addition to reducing the occurrence of resonant mode walking, the present invention provides an additional advantage of reducing the noise level of the washer operation. Specifically, by "decoupling" (i.e. eliminating the fixed coupling between the cabinet 12 and the pedestal 60), the forces exerted on the cabinet 12 are reduced, as described above. This reduction in the forces coupled directly to the cabinet 12 concomitantly reduces cabinet 12 vibration, as also described above, such vibration being a predominant contributor to the washer's operating noise.

In accordance with an additional feature, the washer 10 includes means for leveling cabinet 12. More particularly, cabinet mating portion 80 of supporting foot 64b includes a guide bracket 94 having a first end 94a and a second end 94b. Upper portion 80 of foot 64b has, here, two apertures 80a, 80b disposed therein, as shown. The first end 94a of guide bracket 94 extends into aperture 80a and the second end 94b of guide bracket 94 extends into aperture 80*b*. Ends 94*a*, 94*b* of guide bracket 94 have tapped holes (not shown) disposed therethrough and aligned with a bolt 106. More particularly, bolt 106 extends from the top surface 81 of cabinet mating portion 80 down through such portion 80. Specifically, bolt 106 extends through the tapped holes of guide bracket ends 94*a*, 94*b*.

With this arrangement, washing machine 10 can be levelled. More particularly, by adjusting bolt 106, guide bracket 94, and more specifically the ends 94*a*, 94*b* thereof, are moved vertically within the constraints of apertures 80*a*, 80*b*, respectively. The vertical position of guide bracket 94 in turn determines the vertical excursion of coupling bracket 90 as such excursion is confined to the distance between guide bracket ends 94*a*, 94*b*. Thus, when washing machine 10 is installed for example, the cabinet 12 can be levelled even if the floor surface is not level. Consider for example where the corner of cabinet 12 at the intersection of side walls 12*a*, 12*b* is lower than the other three corners of the cabinet 12 due to a depression in the floor. In this case, one would adjust bolt 106 to raise the guide bracket 94. The upward movement of bracket 94 in turn raises coupling bracket 90 which concomitantly raises the cabinet 12 at such corner.

Figure 3:
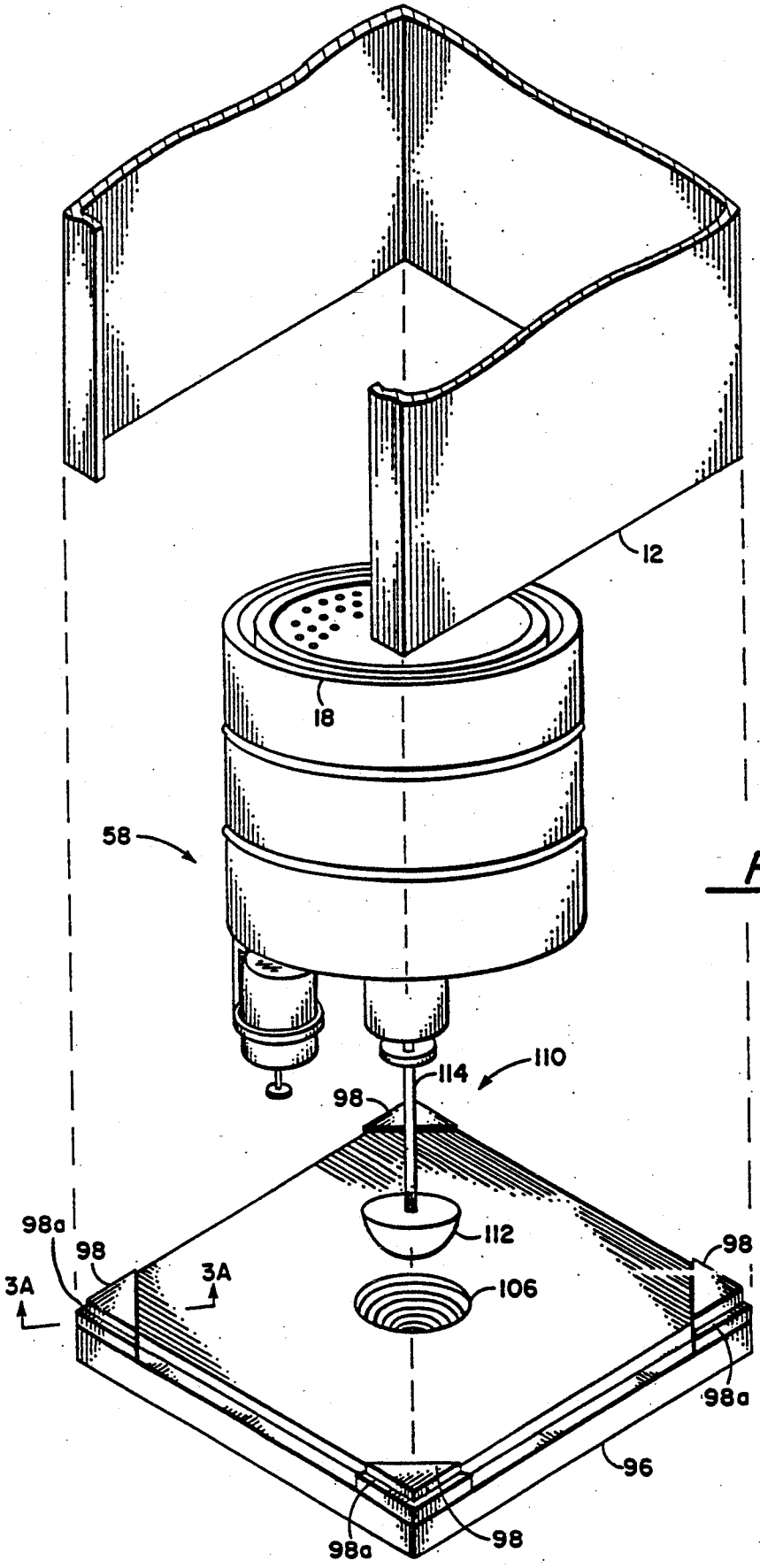
FIG. 3 is a schematic representation of an alternate embodiment for attaching a washer cabinet to a suspension.

Referring now to FIG. 3, an alternate embodiment of apparatus for permitting a washer suspension to move relative to the washer's cabinet 12 is shown to include a base 96. Base 96 is similar to the type used in conventional washing machines in which the suspension arrangement is fixedly coupled to the base 96. For example, base 96 may be adapted to have a hemispherical depression 106 disposed therein (as shown) such that a conventional base level, fixed pivot suspension arrangement 110 may be coupled thereto. More specifically, in assembly a hemispherical member 112 of suspension 110 is disposed over complimentary shaped depression 106. Additionally, upright springs (not shown) fixedly couple the drain tub 18 to the base 96. With this arrangement, the tub assembly 58 (here without pivot dome 52 but with member 112) is permitted to pivot or tilt, as is conventional.

Base 96 differs from conventional bases in that here, disposed over the four corners of base 96, are mating members 98 here, having triangular cross sections. Each of the mating members 98 has a substantially L-shaped ledge portion 98*a* and is seated on base 96 but not fixedly coupled thereto. Rather, there is frictional coupling between members 98 and base 96. Here, mating members 98, like supporting feet 64*a*–64*d* (FIG. 2) are comprised of acetal homopolymer sold under the product name of Celcon by Hoechst Celanese of Chatham, N.J.

Figure 3A:
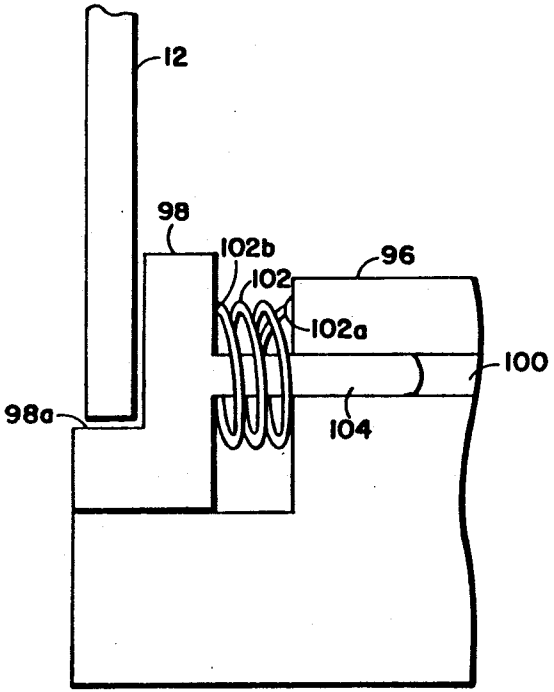
FIG. 3A is a cross-sectional view taken along line 3A—3A of FIG. 3.

In assembly, cabinet 12 is disposed over base 96 and more specifically corner portions of cabinet 12 are seated on the ledge portions 98*a*. This assembly can be seen more clearly in FIG. 3A which is a cross-sectional view of the arrangement of FIG. 3 taken along line 3A—3A. As shown, base 96 has an aperture 100 disposed therein. More specifically, base 96 has four such apertures 100 disposed at the four corners thereof, adjacent to mating members 98. A spring 102 having a first end 102*a* attached to base 96 extends from base 96 and is disposed concentrically with respect to the corresponding aperture 100. Mating member 98 has a dowel 104 extending therefrom and in assembly, such dowel 104 extends partially inside the corresponding aperture 100 of base 96, as shown. With this arrangement, a second end 102*b* of spring 102 contacts mating member 98. In other words, spring 102 concentrically surrounds dowel 104 and is biased to exert an outward force on mating member 98 (i.e. spring 102 acts to push mating member 98 away from the base 96). However, in assembly, cabinet 12 is seated on ledge portion 98*a* of mating member 98, as shown. With this arrangement, the mating members 98 are prevented by cabinet 12 from being pushed off of base 96.

Figure 4:
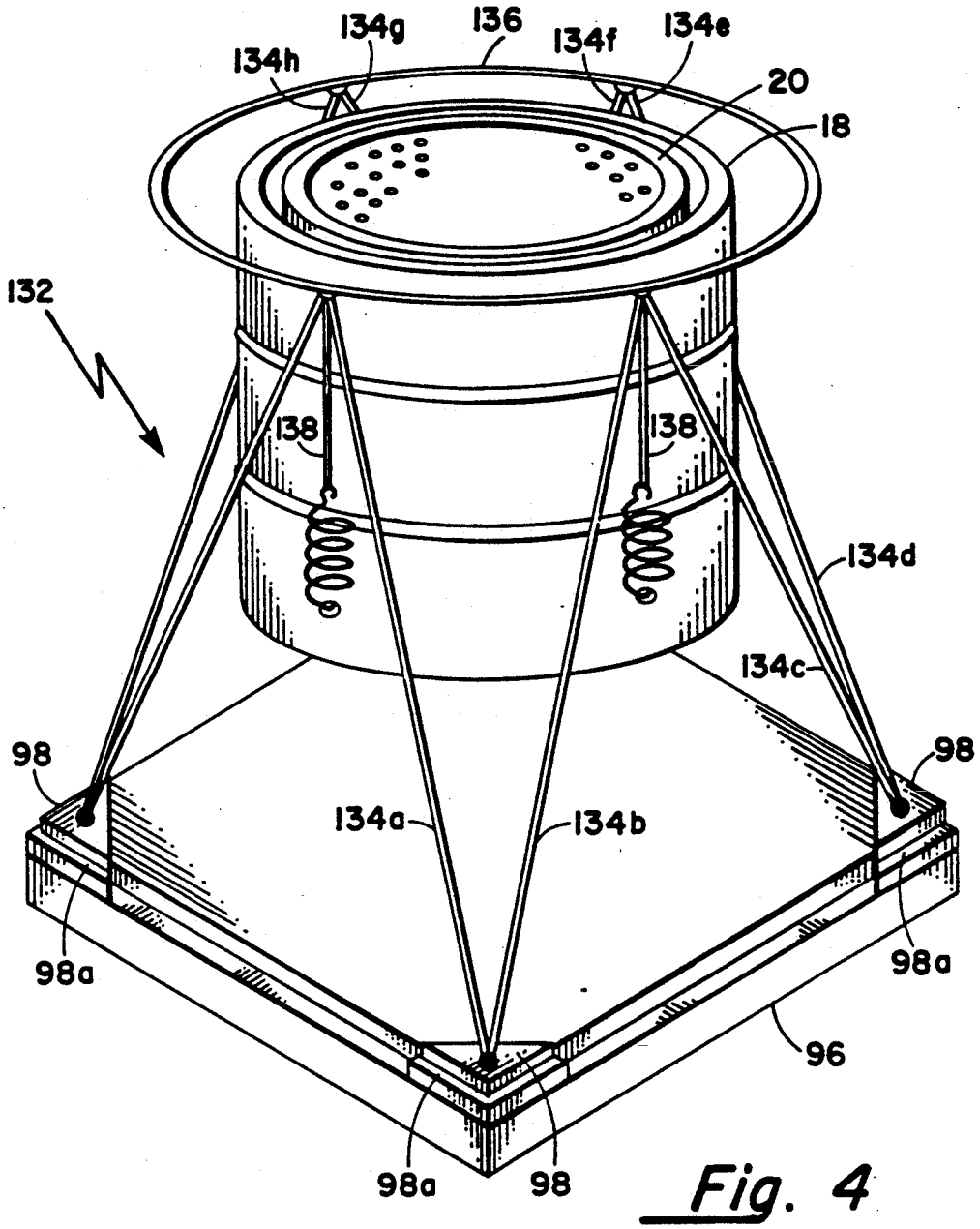
FIG. 4 is a schematic representation of a washer having a pendulous suspension.

Referring now to FIG. 4, an alternate suspension embodiment is shown in combination with the base 96 described above. Here, base 96 supports a pendulous type of suspension 132 having a plurality of upright supports 134*a*–134*h*. Each of such upright supports 134*a*–134*h* has a first end secured to a corresponding one of mating members 98 and a second end secured to a support ring 136, as shown. Pendular means, here comprising springs 138, are coupled to support ring 136. Support ring 136 provides means for hanging the tub assembly 58. Springs 138 are secured to the support ring 136 and drain tub 18 by any suitable means.

Note that the base 96 of FIGS. 3 and 4 alternatively may be implemented with a mid-level type of suspension arrangement. For example, pedestal 60 of FIG. 1 may be implemented with the base 96 of FIGS. 3 and 4 such as by securing upstanding legs 66*a*–66*h* to mating members 98 of base 96 (i.e. instead of to supporting feet 64*a*–64*d*).

In operation of the washer embodiments of FIGS. 3 and 4, the base 96, being fixedly attached to the desired suspension (i.e. base level, fixed pivot suspension 110 in FIG. 3, pendulous suspension 132 FIG. 4, or pedestal 60), is subjected to forces exerted by pivoting assembly 58. However, these forces are not directly transferred to the cabinet 12 because of the mating members 98 described above. More particularly, with such members 98, this arrangement will operate in a manner similar to the arrangement of feet 64*a*–64*d* described above in conjunction with FIG. 2. That is, here again, the coupling between the suspension 132 (FIG. 4) for example (and thus the coupling between the base 96) and the cabinet 12 is frictional as opposed to fixed. Thus, the suspension is permitted to move relative to cabinet 12. In other words, when the mating members 98 are subjected to vertical forces, as a result of the pivoting of tub assembly 58 for example, cabinet 12 remains substantially stationary. That is, when mating members 98 are deflected from such forces (for example downward), the cabinet 12 is not directly subjected to such forces and remains substantially stationary. More particularly, the cabinet 12 is isolated from the suspension by such frictional coupling which can be represented as a friction damper. Moreover, as described above, the effect of the mass of cabinet 12 on the natural frequency of the washer/floor system is thereby reduced. And, as mass is inversely proportional to such natural frequency, the natural frequency is increased.

Note that the above discussion of the washer natural frequency as a function of the spring constant of the floor ($K_f$) assumes that the machine's suspension, and in the case of pedestal 60, that the supporting feet 64*a*–64*d* are in contact with the floor. Simply stated, if this were not the case (for example, if the screw adjustable feet of a conventional washer were improperly installed so that only three such feet contacted to the floor), the spring constant of the floor ($K_f$), as it effects the machine's natural frequency, approaches zero. Since $K_f$ approaching zero causes the composite spring constant K (Eq. 2)

to approach zero, the natural frequency also approaches zero (Eq. 1). This situation is undesirable since decreasing the natural frequency may bring such natural frequency closer to the rate at which the spin tub 20 is rotated during operation. In other words, it may increase the likelihood that the machine will experience resonant mode vibration. Moreover, even if the natural frequency is decreased to be below the maximum spin rate, as the spin tub 20 is rotated up to its maximum spin cycle rate, it will necessarily pass through such natural frequency, thereby increasing the likelihood of resonant mode vibration.

The pedestal 60 (FIG. 1) described prevents this undesirable effect by providing each of the feet 64*a*–64*d* of washer 10 in continuous contact with the floor. Moreover, the present pedestal 60 includes means for adjusting or conforming the pedestal 60 to the floor surface. Such continuous contact and conforming capability is attained both in static conditions as well as dynamic conditions (during washer operation). Moreover, such improved contact between the feet 64*a*–64*d* and the floor increases the frictional forces therebetween, thereby decreasing the tendency of the machine 10 toward frictional mode vibration generally. Additionally, the present pedestal 60 provides improved load distribution on each of the supporting feet 64*a*–64*d* as will be described hereinafter. The way in which these benefits are achieved will be better understood from the following description of FIGS. 5 and 6 which more clearly show pedestal arrangement 60.

Figure 5B:
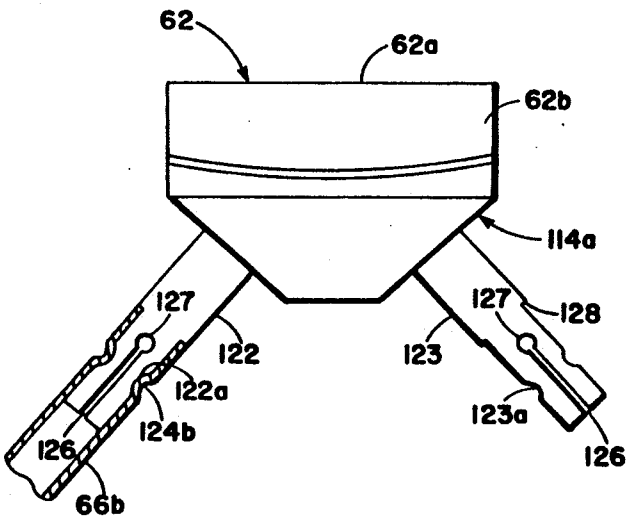
FIG. 5B is an enlarged partially sectioned view of an upper joint of the washer suspension of FIG. 5.
Figure 5:
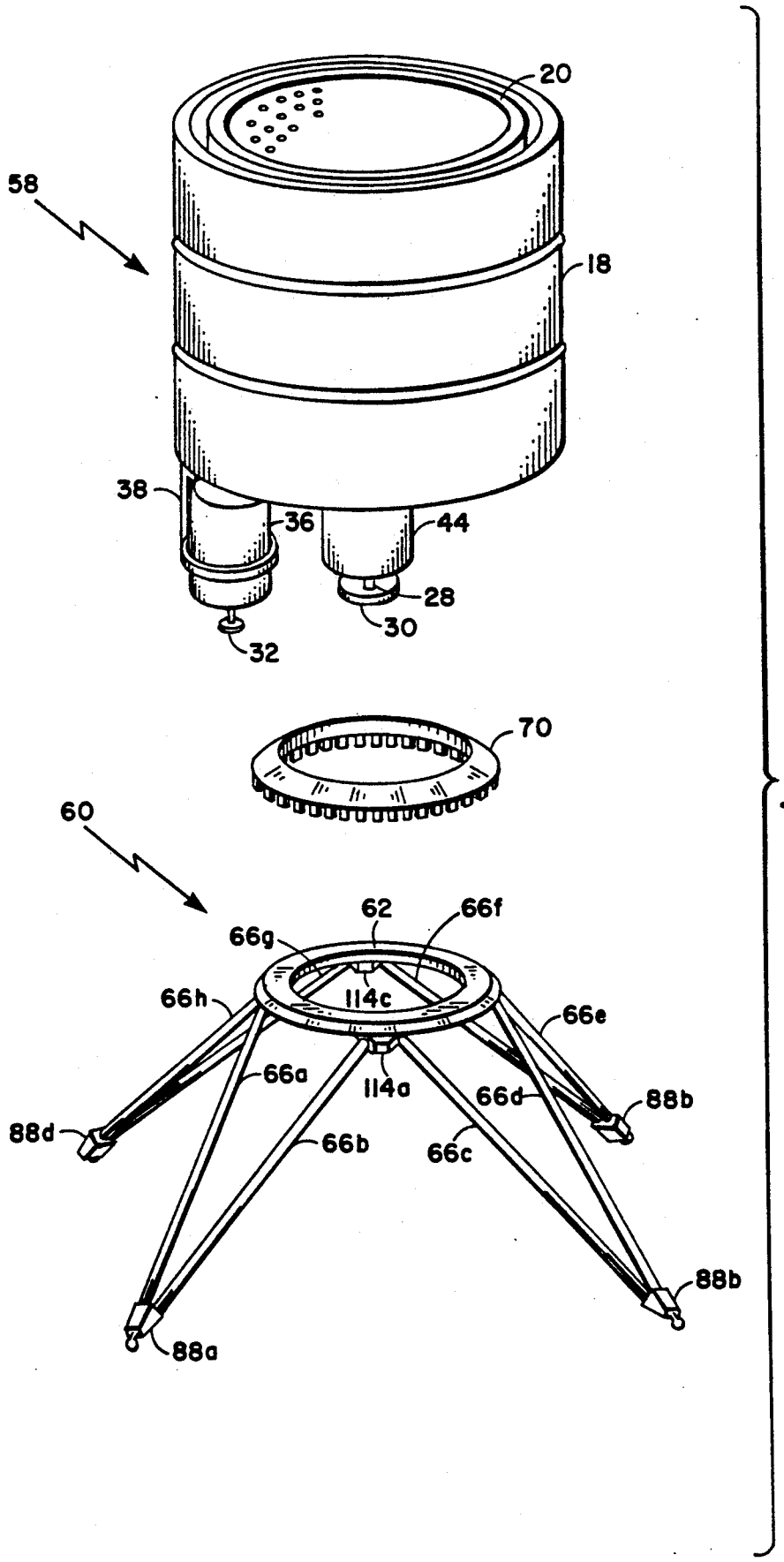
FIG. 5 is an exploded view of the washing machine of FIG. 1.
Figure 6:
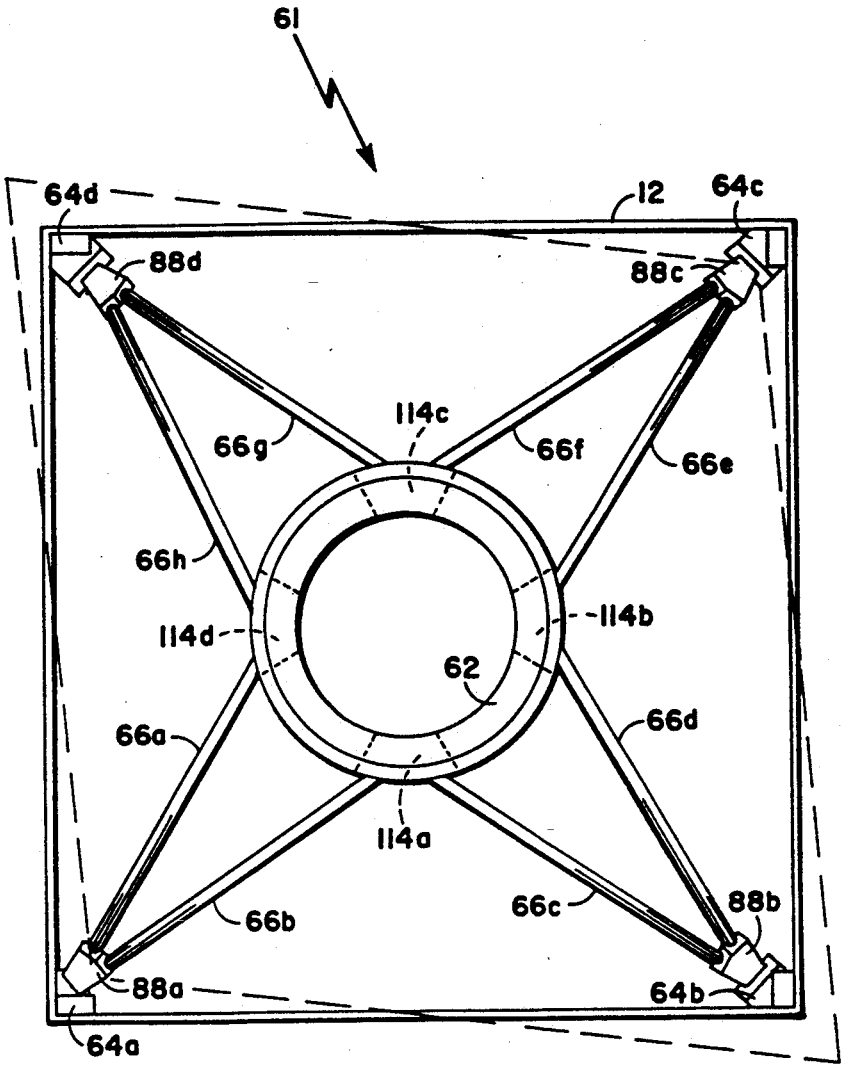
FIG. 6 is a plan view of the washer suspension of FIG. 5.

Referring now to FIGS. 5 and 6, consider specifically pedestal 60 shown to include upstanding legs 66*a*–66*h*, collar 62, lower joints 88*a*–88*d*, and upper joints 114*a*–114*d*. Here, the pedestal 60 further includes supporting feet 64*a*–64*d* (eliminated from FIG. 5 for simplicity). Each of the upper joints 114*a*–114*d* is attached to collar 62 and here, to the bottom surface thereof, as shown by the dotted lines in FIG. 6. Each of the upstanding legs 66*a*–66*h*, and here eight such legs 66*a*–66*h*, has an upper end and a lower end, with each upper joints 114*a*–114*d* being coupled to the upper ends of a first pair of adjacent upstanding legs 66*a*–66*h*, as shown. For example, upper joint 114*a* is coupled to the upper ends of adjacent upstanding leg pair 66*b*, 66*c*; whereas upper joint 114*c* is coupled to the upper ends of adjacent ones of upstanding leg pair 66*f*, 66*g*. Each lower joint 88*a*–88*d* is coupled to the lower ends of a second pair of adjacent ones of upstanding legs 66*a*–66*h*. For example, lower joint 88*a* is coupled to lower ends of adjacent upstanding leg pair 66*a*, 66*b*; whereas lower joint 88*b* is coupled to lower ends of adjacent upstanding leg pair 66*c*, 66*d*, as shown.

Note that here, the four upper joints 114*a*–114*d* are spaced by 90 degrees. Additionally, the four lower joints 88*a*–88*d* are spaced by 90 degrees. Moreover, the upper joints 114*a*–114*d* and lower joints 88*a*–88*d* are positioned in a staggered manner so that adjacent ones of upper joints 114*a*–114*d* and lower joints 88*a*–88*d* are spaced apart by forty-five degrees. As shown in FIG. 6, the first and second pairs of upstanding legs 66*a*–66*h* coupled to adjacent ones of lower joints 88*a*–88*d* and upper joints connectors 114*a*–114*d*, respectively, have a common leg 66*a*–66*h*. For example, consider upper joint 114*a* and adjacent lower joint 88*b*. Upper joint 114*a* is coupled to a first pair of adjacent upstanding legs 66*b*, 66*c* and lower joint 88*b* is coupled to a second pair of adjacent upstanding legs 66*c*, 66*d*. Moreover, such first pair of upstanding legs 66*b*, 66*c* share a common leg (namely 66*c*) with the second pair of upstanding legs 66*c*, 66*d*. Stated differently, supporting feet 64*a*–64*d* are adapted for supporting the washer 10 on a floor. Each of such feet 64*a*–64*d* has a lower joint 88*a*–88*d*, respectively, coupled to the lower ends of a pair of upstanding diverging rods (i.e. upstanding legs) 66*a*–66*h* that connect to different ones of the upper joints 114*a*–114*d* to support collar 62. Moreover, each joint 88*a*–88*d*, 114*a*–114*d* provides means for rotatably coupling the corresponding pair of rods 66*a*–66*h*. More specifically, the rotatable coupling provided by lower joints 88*a*–88*d* is achieved in their ball 92 and socket 86 arrangement. The rotatable coupling provided by upper joints 114*a*–114*c* is achieved by the rotatable flexibility of such joints 114*a*–114*c* (i.e. alternatively referred to as live hinges).

Pedestal 60 in combination with cabinet 12 provides a completely rigid (i.e. non-flexible) truss-like arrangement 61 (FIG. 6). Here, the members (M) comprising truss-like arrangement 61 are the upstanding legs 66*a*–66*h*, the four walls of cabinet 12, and struts coupled between each of upper joints 114*a*–114*d* (here, such struts being provided by collar 62). One way of characterizing the rigid truss-like arrangement 61 is by the relationship between the number of joints (J) in the system (i.e. here system joints including the lower joints 88*a*–88*d* and the upper joints 114*a*–114*d*) and the number of members (M) (here, upstanding legs 66*a*–66*h*, four struts disposed between upper joints 114*a*–114*d*, and the four walls of cabinet 12, for a total of sixteen members). Generally, to provide a rigid truss-like arrangement 61, the number of members is equal to at least three times the number of system joints minus six. As the present arrangement 61 has eight joints, eighteen members would be required to provide a completely rigid system. As noted above, the number of members here is sixteen. One of the additional members would be disposed across the central aperture of collar 62 and the other diagonally across the cabinet 12 between two diagonally opposing feet 64*a*, 64*c* or 64*b*, 64*d*. However, clearly it is not feasible to have the former member disposed across collar 62, as this would preclude the tub assembly 58 from being seated thereon as shown in FIG. 1 with the bearing housing 44 and drive shaft 28 extending down through the central aperture of collar 62. While the omission of such member may cause a slight bending moment on collar 62, the effect has been found to be negligible. Furthermore, regarding the latter member disposed diagonally across cabinet 12, the omission of such member in the present arrangement provides important advantages, as described below in conjunction with the continuous contact maintained between the supporting feet 64*a*–64*d* and the floor without significantly sacrificing the rigidity of the arrangement 61. In view of the above, the preferred truss-like pedestal 60 has a relationship between the number of members (M) and the number of joints (J) of $M \geqq (3 \times J) - 8$ and more preferably, $M = (3 \times J) - 8$.

With the above-described truss-like pedestal 60, the members (M) thereof are in substantially pure compression or tension. This arrangement is desirable since the members thereof require a minimum of mass to resist a given force. The way in which this is achieved is by designing washer 10 so that the centroids (i.e. the center of mass) of each member of truss-like arrangement 61 intersect in combination with providing rotatable lower joints 88*a*–88*d* and upper joints 114*a*–114*c*, as noted above. The centroid of each of the members of pedestal 60 is disposed axially through the center of each such member. As is known, when the centroids of a mechanical system intersect and all joints are rotatable joints, as in the present washer 10, the system is in pure compression or tension. Here, each one of upstanding legs 66a–66h is a tubular, or rod-like member comprised of steel tubing with a diameter of approximately ⅞ inches. The length of each of upstanding legs 66a–66h is here, fifteen inches and the walls of the steel tubing have a thickness of approximately 0.035 inches.

It is notable that the present pedestal 60 is a statically determinant system, meaning that the loads on each of the four feet 64a–64d imposed by the rotating and pivoting tub assembly 58, are not affected by the deflection of a compliant floor. Further, when vertically loaded, each of the four feet 64a–64d compresses the floor downward until each such foot 64a–64d carries one-quarter of the weight of the washer 10. Since the supporting feet 64a–64d move independently, the ones of such feet 64a–64d contacting a stiff floor region will move less than those ones of feet 64a–64d contacting soft floor regions. Stated differently, any one of the four supporting feet 64a–64d may be lifted off the floor surface without changing the loads on any one of such feet 64a–64d. This characteristic differentiates pedestal 60 from conventional washer suspensions as the latter arrangements are statically indeterminant. In statically indeterminant systems, the four feet 64a–64d cannot move independent of each other. Thus, in prior art statically indeterminant washers, a foot contacting a soft region of the floor surface will not compress the floor sufficiently when vertically loaded and therefore will exert less than one-quarter of the washer weight on the floor surface.

Not that the load carried by each of the supporting feet 64a–64d is directly related to the ability of the pedestal 60 to resist frictional walking. That is, during dynamic loading the supporting feet 64a–64d must have ample frictional resistance to prevent sliding on the floor surface. The frictional resistance associated with each of the supporting feet 64a–64d is proportional to the product of the vertical load on such foot 64a–64d and the coefficient of friction associated with such foot 64a–64d. If the horizontal load on any of the feet 64a–64d exceeds the frictional resistance associated therewith, the foot 64a–64d and the washer 10 will slide across the floor surface (i.e. will experience frictional walking).

As mentioned above, for the statically determinant washer 10 herein described, each of the four feet 64a–64d are equally vertically loaded. Thus, each of such feet 64a–64d has equal frictional resistance. With this arrangement, the washer 10 is less likely to experience frictional walking since the frictional resistance of each of the feet 64a–64d is not reduced to a value likely to be overcome by horizontal loads. That is, statically determinant washer 10 is less prone to frictional walking than statically indeterminant structures since in the latter type of system, unequal loading may result in a low frictional resistance associated with the supporting feet 64a–64d.

Considering statically determinant washer 10, it is apparent from the discussion of the rotatable lower joints 88a–88d and the rotatable upper joints 114a–114d that the pedestal 60 is permitted to rotate about the supporting feet 64a–64d. More particularly, it is the rotatable lower joints 88a–88d and the rotatable upper joints 114a–114d in conjunction with the angle at which upstanding legs 66a–66h are disposed (here at a 45 degree angle to the sides of the cabinet 12), that allows the pedestal 60 along with cabinet 12 to deform from the square footprint to a parallelogram shape, as shown by the dotted lines in FIG. 6. Note that when the footprint of the washer 10 changes shape to form a parallelogram, the supporting feet 64a–64d move out of plane. This feature of washer 10 can be clearly seen in FIG. 6A which shows a schematic view of pedestal 60 (with supporting feet 64a–64d designated by dots for simplicity) when the washer 10 deforms to the parallelogram shape shown by the dotted lines in FIG. 6. Note that, it is this deformable capability of the washer 10 which provides constant or continuous contact between supporting feet 64a–64d and the floor, both under static and dynamic conditions. Stated differently, such deforming action allows the pedestal 60 to conform to the floor surface.

Figure 6A:
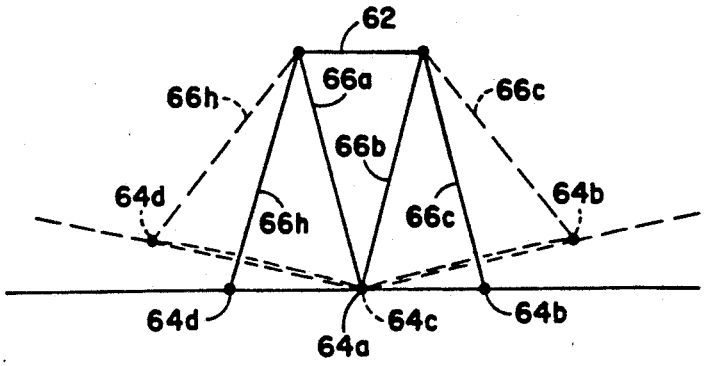
FIG. 6A is a schematic view of the washer of FIG. 6.

The way in which such continuous contact is achieved will be better understood by considering the pedestal 60 and cabinet 12 at installation of washer 10. Consider for example the situation where, when the washer 10 is installed, only two 64a, 64c of the four supporting feet 64a–64d (on diagonally opposing corners of cabinet 12), initially make contact with the floor while the other two feet 64b or 64d are in the air due to depressions in the floor surface under the non-contacting feet 64b, 64d, for example. The floor contacting feet 64a, 64c are pushed or forced downward by the weight of the tub assembly 58 on the pedestal 60. More particularly, since the rotatable joints 88a–88d and 114a–114d allow the upstanding legs 66a–66h to rotate relative to such joints 88a–88d and 114a–114d, the contacting feet 66a, 66c are spread outward as the weight of the tub assembly 58 pushes downward on collar 62. Simultaneously, the two non-contacting feet 66b, 66d are forced or pulled inward as the cabinet 12 forms a parallelogram. Note that the frictional force between the rubber pads 84a–84d disposed on the bottom of supporting feet 64a–64d is overcome by the weight of the tub assembly 58. This motion continues until each of the four feet 64a–64d contacts the floor and the static weight of the washer 10 is distributed evenly on all four feet 64a–64d. During washer installation, the outward or inward parallelogramming motion may be approximately one-quarter inch per supporting foot 64a–64d for a floor surface out of plane by approximately one inch. Note that the dotted lines of FIG. 6A show the side view of pedestal 60 when the washer 10 is installed as described above. More particularly, the floor surface shown by the dotted line having depressions under feet 64b, 64d results in supporting feet 64a, 64c initially contacting the floor while the remaining feet 64b, 64d do not. Through the action described above, all four feet 64a–64d will contact the non-uniform floor, as shown. The pedestal 60 and floor surface shown in solid lines represent the condition where the floor surface is in plane or uniform.

Note that this same parallelogramming motion occurs during the washer spin cycle. For example, consider the case where one 64a of the four feet 64a–64d is subjected to a higher vertical load than the remaining feet 64b–64d while the opposing foot 64c is subjected to a concomitantly lighter load, such as may occur during the spin cycle. Under this condition, the lighter loaded foot 64c has a higher vertical load than the equivalent lightly loaded foot in the prior art statically indeterminant structure. That is, in the prior art, when a heavily loaded foot deflects downward by a certain amount, the opposing foot moves upward by a substantially equal amount, thereby decreasing the frictional resistance associated with such lightly loaded foot. In the present arrangement however, when the heavily loaded foot 64a deflects downward by a certain amount, the opposing foot 64c does not move upward by a substantially equal amount, but rather moves upward by a lesser amount due to inter alia, the joint 88a–88d and 114a–114c rotation of the pedestal 60. However, since vertical (i.e. out of plane) movement of the floor surface resulting from the forces exerted thereon by the pivoting tub assembly 58 are much smaller than the extent to which a floor surface may be out of plane, the degree of parallelogramming is much smaller during the spin cycle. For example, the dynamic parallelogramming may cause an outward or inward motion of supporting feet 64a–64d of less than approximately 0.002 inches.

With this arrangement, substantially continuous contact between the supporting feet 64a–64d, and more specifically, rubber pads 84a–84d, and the floor is achieved. Moreover, this continuous contact or conforming of the pedestal 60 to the floor is achieved automatically. In other words, the techniques for ensuring or improving contact between the washer's feet and the floor, such as the use of screw adjustable supporting feet, is unnecessary.

Figure 7:
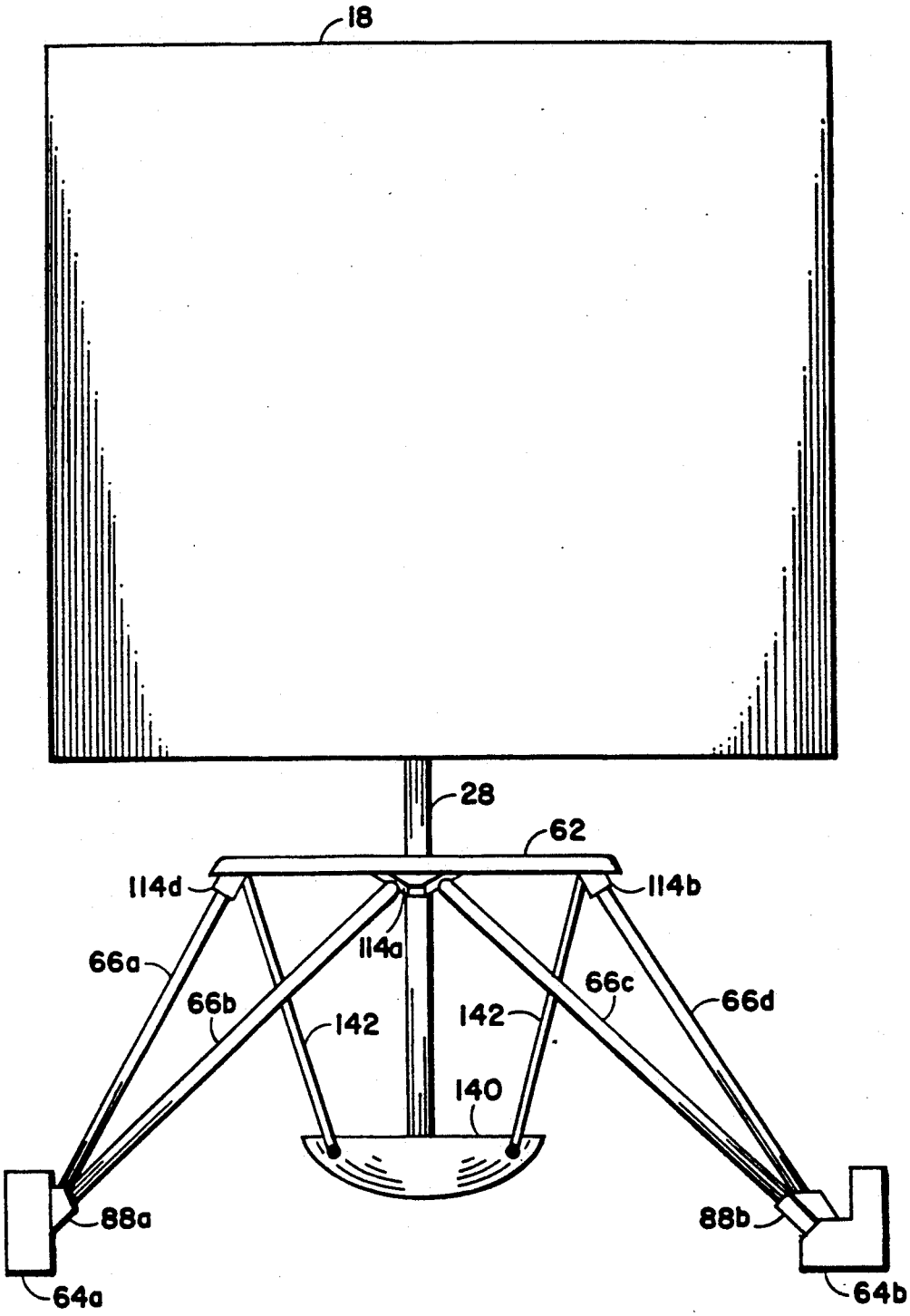
FIG. 7 is a schematic representation of a washer having a base level, fixed pivot suspension.

Referring now to FIG. 7, an alternate embodiment of a washer suspension is shown in combination with pedestal 60. Here, the pedestal 60 is used in conjunction with a base level, fixed pivot suspension. More particularly, the suspension shown here includes a drive shaft 28 and a pivot dome 140. The suspension also includes a plurality of upright springs omitted here for simplicity but arranged similar to springs 74 of FIG. 1. Pivot dome 140 is coupled to collar 62 as shown by a plurality of struts 142, such struts 142 being attached therebetween by any suitable means. With this arrangement, the base level, fixed pivot suspension is provided with the benefits described above for the truss-like pedestal 60. That is, inter alia, the suspension thus provided is statically determinant and has a improved immunity toward frictional walking.

Referring now back to FIG. 5 as well as to FIGS. 5A and 5B, the manufacture and assembly of washer 10 will be described. A cross-sectional view of an exemplary one 88b of joints 88a–88d is shown in FIG. 5A. As mentioned above, joints 88a–88d are molded plastic parts, here comprised of acetal homopolymer sold under the product name of Celcon M90 by Hoechst Celanese Corporation of Chatham, N.J. The first end 89 of joint 88b has a pair of adjacent apertures 115, 116 into which the second ends of upstanding legs 66c, 66d extend, as mentioned above. More particularly, the inner surface of each such aperture 115, 116 has a circumferential rib 119, 120, respectively. Each of upstanding legs 66a–66h has a circumferential groove 118a–118h, respectively, disposed adjacent the second end thereof (here grooves 118c, 118d of upstanding legs 66c, 66d, respectively, being shown). During fabrication, the second ends of upstanding legs 66c, 66d are insert injection molded into the apertures 115, 116 of joint 88b. With this arrangement, the manufacture of providing pedestal 60 is eased and its cost reduced, as no fastening parts are required to couple legs 66a–66h to the lower joints 88a–88d. The second end 91 of joint 88b has ball joint 92 extending therefrom, as shown. As mentioned above, ball joint 92 mates with complimentary socket 86 of supporting foot 64b (FIG. 2).

Considering now FIG. 5B, showing an exemplary one 114a of upper joints 114a–114d, note that the orientation of upper joint 114a in FIG. 5B is different than that in FIG. 5. Specifically, upper joint 114a is shown in FIG. 5B with upstanding leg 66b disposed in a vertical orientation. Additionally, upper joint 114a is partially sectioned and upstanding leg 66c (coupled to upper joint 114a as shown in FIGS. 5 and 6) is not shown in FIG. 5B so that the features of upper joint 114a can be more clearly seen.

Upper joints 114a–114d are here insert injection molded parts formed by inserting collar 62 into a mold and injecting plastic to form the upper joints 114a–114d. More particularly, collar 62, here having a top surface 62a and an overhanging rim 62b, is comprised of steel and is painted by any conventional technique before being inserted into the mold. Here, the plastic injected to form upper joints 114a–114d is acetal homopolymer sold under the product name of Celcon M90 by Hoechst Celanese of Chatham, N.J. Upper joints 114a–114d, as shown by reference to exemplary upper joint 114a, have a pair of elongated members 122, 123 extending therefrom. More specifically, each of the elongated members 122, 123 has a slot 126 extending partially therethrough and a ridge 128. The round portion 127 disposed at the top of slot 126 provides strain relief. The first ends of each of upstanding legs 66a–66h have a circumferential groove 124a–124h, respectively, as shown in FIG. 5B for leg 66b. The elongated members 122, 123 have complimentary circumferential grooves 122a, 123a, respectively, as shown in FIG. 5B for member 123. In assembly, the upstanding legs 66a–66h are pressed onto the elongated members 122, 123 so that the first ends of legs 66a–66h butt against the ridge 128 of elongated members 122, 123. The upstanding legs, for example leg 66b, exerts pressure on the corresponding member 122, thereby compressing such member 122 to substantially narrow or close slot 126 during assembly. After assembly, the slot 126 widens and the leg is locked in place with the groove 124 mating with the groove 122b.

Considering again FIG. 5, the preferred method of assembly of washer 10 will now be described. A subassembly comprising pedestal 60 and including supporting feet 64a–64d may be assembled. Here, such subassembly is fabricated by insert injection molding the upstanding legs 66a–66h to the corresponding ones of lower joints 88a–88d in a manner described above in conjunction with FIG. 5A. Also, the injection molded portion comprising collar 62 and upper joints 114a–114d is formed as described above in conjunction with FIG. 5B. With this arrangement, the first ends of upstanding legs 66a–66h are pressed onto the extending members 122, 123 of upper joints 114a–114d, as was also described in conjunction with FIG. 5B. Pedestal 60 is thus assembled.

Several ways of coupling the joints 88a–88d to the corresponding ones of supporting feet 64a–64d may be implemented. For example, the four supporting feet may be placed in accordance with their spacing in the washer 10 (i.e. ninety degrees apart), such as on a conveyor belt, and the pedestal 60 then lowered thereover so that the lower joints 88a–88d are aligned with the corresponding feet 64a–64d, respectively, as shown. With this arrangement, a pressing tool is lowered over collar 62 and force exerted downward thereon causing the ball joints 9 extending from joints 88a–88d to snap into the complimentary sockets 86 of the corresponding feet 64*a*–64*d*.

Once pedestal 60 is coupled to supporting feet 64*a*–64*d*, the traversing member 70 is placed over collar 62 with the central aperture of traversing member 70 aligned with that of collar 62. Tub assembly 58 is then seated over traversing member 70. More particularly, tub assembly 58 is lowered over traversing member 70 with the bearing housing 44, drive shaft 28, and driven pulley 30 extending down through the central apertures of traversing member 70 and collar 62. Specifically, pivot dome 52 (FIG. 1) rests on traversing member 70. Motor 36 and associated hardware (bracket 38 and drive pulley 32) extend below traversing member 70 but external to the central aperture thereof. Additional conventional parts, such as the drive belt 34, upright springs 74, centering springs 72, a pump (not shown), and hoses (not shown), are then added to the assembly. Additionally, the motor bracket portion 38*b* is then secured between L-shaped motor bracket portion 38*a* and bearing housing 44.

Finally, the outer cabinet 12 is lowered over the assembly. Specifically, the cabinet 12 has a back wall, side walls, a top cover 14 (FIG. 1), and a horizontal brace along the bottom of the front of the cabinet 12 and the four foot coupling brackets 90 are welded in place. That is, the front of the cabinet 12 has an aperture therein substantially extending the height and width of the washer 10, as is conventional. Coupling brackets 90 (coupling the supporting feet 64*a*–64*d* to the cabinet 12, FIG. 2) are already welded to cabinet 12. Note that when the cabinet 12 is lowered over the assembly, the brackets 90 are lowered over the upper cabinet coupling portions 80 (FIG. 2) of the supporting feet 64*a*–64*d*. Once cabinet 12 is in place, the bracket 94 and bolt 106 are installed and the wiring to the electronic controls of control panel 16 is connected to other washer components such as the motor 36 and the pump (not shown), as is conventional.

Once the pedestal 60 and the tub assembly 58 are positioned, the upright 74 springs and centering springs 72 are put in place. Additionally, the drive belt 34 is coupled between drive pulley 32 and driven pulley 34 and the other conventional parts, such as the pump, upright springs 74, centering springs 72, and hoses are added.

Having described preferred embodiments of the invention, it should now become evident to one of skill in the art that other embodiments incorporating its concepts may be used. It is felt, therefore, that this invention should not be restricted to the disclosed embodiments, but rather should be limited only by the spirit and scope of the appended claims.

What is claimed is:

1. A washing machine comprising:

a cabinet;

a tube assembly disposed in said cabinet for processing a wash load, said tub assembly comprising a drain tube and a spin tub disposed in said drain tub;

a plurality of feet adapted for contacting a floor surface to support said washing machine;

suspension means for supporting said tub assembly in said cabinet and for permitting said tub assembly to pivot, said suspension means being coupled directly to said feet; and means for permitting the suspension means to move relative to the cabinet.

2. The washing machine recited in claim 1 wherein said suspension means comprises a pedestal, said pedestal comprising:

said plurality of supporting feet; and a collar spaced from said plurality of supporting feet by a plurality of upstanding legs, wherein said tube assembly is disposed over said collar.

3. The washing machine recited in claim 2 wherein said suspension means further comprises a traversing member disposed over said collar, wherein said tub assembly is seated on said traversing member.

4. The washing machine recited in claim 2 wherein the means for permitting the suspension means to move independent of the cabinet comprises a plurality of brackets corresponding to said plurality of supporting feet, each of said plurality of brackets being fixedly coupled to said cabinet and frictionally coupled to one of said plurality of feet.

5. The washing machine recited in claim 4 wherein said feet are comprised of a material having a coefficient of friction less than approximately 0.25.

6. The washing machine recited in claim 1 wherein said suspension means comprises pendular means for hanging said tub assembly.

7. The washing machine recited in claim 6 further comprising a base coupled to said suspension means, said means for permitting the suspension means to move independent of the cabinet comprising a mating member, said coupling member being moveable relative to said cabinet.

8. The washing machine recited in claim 7 further comprising a base coupled to said suspension means, said means for permitting the suspension means to move relative to the cabinet comprising a mating member, said mating member being moveable relative to said cabinet.

9. The washing machine recited in claim 1 wherein said suspension means comprises a base having a first pivot surface and wherein said tub assembly further comprises a second, complimentary pivot surface seated on said first pivot surface.

10. A washing machine comprising:

a cabinet;

a tub assembly disposed in said cabinet for processing a wash load, said tub assembly comprising a drain tub and a spin tub disposed in said drain tub;

suspension means for supporting said tub assembly in said cabinet and for permitting said tub assembly to pivot; and means for isolating the mass of the cabinet to provide the washing machine with a natural frequency above the maximum spin speed of the spin tub.

11. A washing machine comprising:

a cabinet;

a tub assembly disposed in said cabinet for processing a wash load, said tub assembly comprising a drain tub and a spin tub disposed in said drain tub;

suspension means for supporting said tub assembly in said cabinet for permitting said tub assembly to pivot;

means for slidably coupling said suspension means to said cabinet; and said means for slidably coupling said suspension to said cabinet comprising:

(a) a plurality of supporting feet coupled to said suspension; and (b) a plurality of brackets corresponding to said plurality of supporting feet, each one of said plurality of brackets being fastened to said cabinet, wherein one of the plurality of supporting feet is disposed in slidable contact with said cabinet.

12. The washing machine recited in claim 11 wherein said means for slidably coupling said suspension to said cabinet further comprises means for leveling said cabinet.

* * * * *